US006601396B2

(12) United States Patent
Bair, III et al.

(10) Patent No.: US 6,601,396 B2
(45) Date of Patent: Aug. 5, 2003

(54) FREEZER DEFROST METHOD AND APPARATUS

(75) Inventors: Richard H. Bair, III, Asheville, NC (US); Chuan Weng, Weaverville, NC (US)

(73) Assignee: Kendro Laboratory Products, LP, Asheville, NC (US)

( * ) Notice: Subject to any disclaimer, the term of this patent is extended or adjusted under 35 U.S.C. 154(b) by 0 days.

(21) Appl. No.: 10/006,674

(22) Filed: Dec. 10, 2001

(65) Prior Publication Data

US 2003/0101737 A1 Jun. 5, 2003

Related U.S. Application Data

(60) Provisional application No. 60/334,607, filed on Dec. 3, 2001.

(51) Int. Cl.[7] ..... F25B 47/02

(52) U.S. Cl. ..... 62/155; 62/156; 62/80

(58) Field of Search ..... 62/151, 155, 156, 62/140, 158, 234, 80, 81, 82

(56) References Cited

U.S. PATENT DOCUMENTS

| | | | | |
|---|---|---|---|---|
| 4,432,211 A | * | 2/1984 | Oishi et al. | 62/155 |
| 4,910,966 A | * | 3/1990 | Levine et al. | 62/156 X |
| 5,727,395 A | * | 3/1998 | Guo et al. | 62/80 X |
| 6,205,800 B1 | * | 3/2001 | Topper et al. | 62/156 |

* cited by examiner

*Primary Examiner*—Harry B. Tanner
(74) *Attorney, Agent, or Firm*—Baker & Hostetler LLP

(57) ABSTRACT

Methods and apparatus for freezer defrost, which are particularly suited for an automated system, include the formulation of algorithms utilized for this purpose. The algorithms are included in the firmware of an embedded controller and operate the freezer defrost cycle at temperature lows for increased efficiency. An application of the freezer defrost method and apparatus is also disclosed.

20 Claims, 3 Drawing Sheets

FREEZER DEFROST METHOD AND APPARATUS

PRIORITY

The following application claims priority to Provisional Application No. 60/334,607 entitled Freezer Defrost Method and Apparatus, filed Dec. 3, 2001, herein incorporated by reference.

FIELD OF THE INVENTION

The present invention generally relates to refrigerated devices having cooled enclosures such as refrigerators and/or freezers. More specifically, the present invention relates to minimizing the maximum temperature that the cabinet temperature of an enclosed freezer will attain during defrost, thus increasing performance.

BACKGROUND OF THE INVENTION

Commercial and domestic refrigerators and freezers are provided with a refrigeration unit for cooling. The refrigeration unit typically has a compressor driven by a compressor motor, a condenser and an evaporator. As the refrigeration unit operates, water vapor condenses on the evaporator and results in the build-up of frost and ice on the evaporator. The build-up of frost and ice on the evaporator results in diminished airflow through the evaporator and a reduction in the ability of the refrigeration unit to cool the air within the refrigerator or freezer. To enhance the efficiency of refrigerators and lower their power consumption, many refrigerators are designed to periodically defrost the evaporator. Defrost devices, such as heaters, are often used to hasten the defrost operation. Also known are refrigerators that defrost on demand by sensing an accumulation of ice and, in response, initiate a defrost operation.

However, the prior art refrigerators and freezers fail to teach a demand defrost scheme that uses temperature measurements that are directly related to heat transfer principles as a basis for determining condensate accumulation. Accordingly, the prior art refrigerators and freezers have inherent inefficiencies. The prior art refrigerators and freezers are also burdened with overly complex algorithms and timing considerations.

Generally, there are three known ways or techniques for controlling the operation of a compressor and a defrost heater with what is referred to herein as a defrost cycle controller. These three ways are referred to herein as real or straight time, cumulative time, and variable time.

The real time technique involves monitoring the connection of the system to line voltage. The interval between defrosts is then based on a fixed interval of real time.

The cumulative time method involves monitoring of the cumulative time a compressor is run during a cooling interval. The interval between defrost cycles is then varied based on the cumulative time the compressor is run.

The variable time method is the most recently adopted method and involves allowing for variable intervals between defrost cycles by monitoring both cumulative compressor run time as well as continuous compressor run time, and defrost length. The interval between defrost cycles then is based more closely on the need for defrosting.

As is known, during a defrost cycle there is also dripping of melted frost to a drip pan from which the melted frost evaporates. This is known as the drip mode or cycle.

The United States government, as well as other governments, has continuously enacted more and more stringent laws and regulations relating to the efficiency of refrigerators and freezers, particularly as home appliances. As a result, much research has been directed to more effective control over the refrigeration cycles of refrigerators and freezers and, particularly, to the defrost cycle, since in this cycle, the effect of refrigeration is, on the one hand, counteracted by removing cold from the enclosure, and on the other hand, enhanced by increasing the efficiency of refrigeration by removing insulating frost.

Furthermore, different types of frost control systems have been utilized, varying from the use of a timer to periodically initiate and terminate defrost to sophisticated infrared radiation and sensing means mounted on the fins of the refrigerant carrying coils.

Other such defrost systems generate a signal in response to an air pressure differential across the heat exchanger caused by frost accumulation blocking the airflow through the heat exchanger. Other defrost systems require coincidence between two independently operable variables each of which may indicate frost accumulation such as air pressure within the shroud of the evaporator and the temperature differential within the evaporator coil. Another system may be the combination of a periodic timer to initiate defrost with a thermostat for sensing refrigerant temperature to terminate defrost. Another defrost system is one wherein compressor current or another operational parameter is monitored and compared to a reference level signal generated during a non-frost condition such that a variation from that reference level of the parameter being monitored indicates that it is time-to-initiate the defrost cycle.

These defrost systems can generally be grouped into two specific categories: timed and demand. A timed system simply initiates defrost periodically whether frost has accumulated or not based on the knowledge that all heat pump systems will need periodic defrosting under certain weather conditions. The amount of time chosen for periodically initiating defrost is a compromise between a short time that would cause a waste of efficiency during weather conditions which do not necessitate defrost and a long time which would allow the heat pump to operate inefficiently with a severely frosted evaporator coil. The advantage of a timed defrost system is that the heat pump will be defrosted periodically. The disadvantage is that the needed time between defrosts is never quite the same as the preset time due to weather conditions which differ from day to day and from location to location.

Demand defrost systems attempt to initiate a defrost cycle as a function of some system parameter which is related to a measure of frost accumulation. The advantage of a demand defrost system is that the heat pump is allowed to continue normal operation without energy consuming defrost cycle until defrost is actually required. The disadvantage of demand defrost systems is that initial equipment cost is high and demand systems are less reliable in their ability to sense the need for defrost.

Accordingly, it is desirable to provide an improved automatic freezer defrost cycle that is independent of the normal cabinet temperature cycle.

SUMMARY OF THE INVENTION

It is therefore a feature and advantage of the present invention to provide an automatic freezer defrost cycle that is dependent on the normal cabinet temperature cycle by identifying cold excursions of the temperature cycle and initiating defrost at that point. Thus, the defrost cycle initiates at cooler temperatures within the normal temperature cycle and therefore exposes the interior of the freezer to warmer temperatures less frequently.

The above and other features and advantages are achieved through the use of a novel algorithm as herein disclosed. In accordance with one embodiment of the present invention, a method of automating freezer defrost cycles is disclosed. This method determines when the defrost cycle should begin and sets a flag which indicates a time for defrost when the low point in the temperature cycle is reached. Thus, initiating the defrost cycle at this low point in the temperature cycle results in minimizing the maximum temperature that the cabinet temperature of the enclosed freezer will attain during defrost, thus increasing performance.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
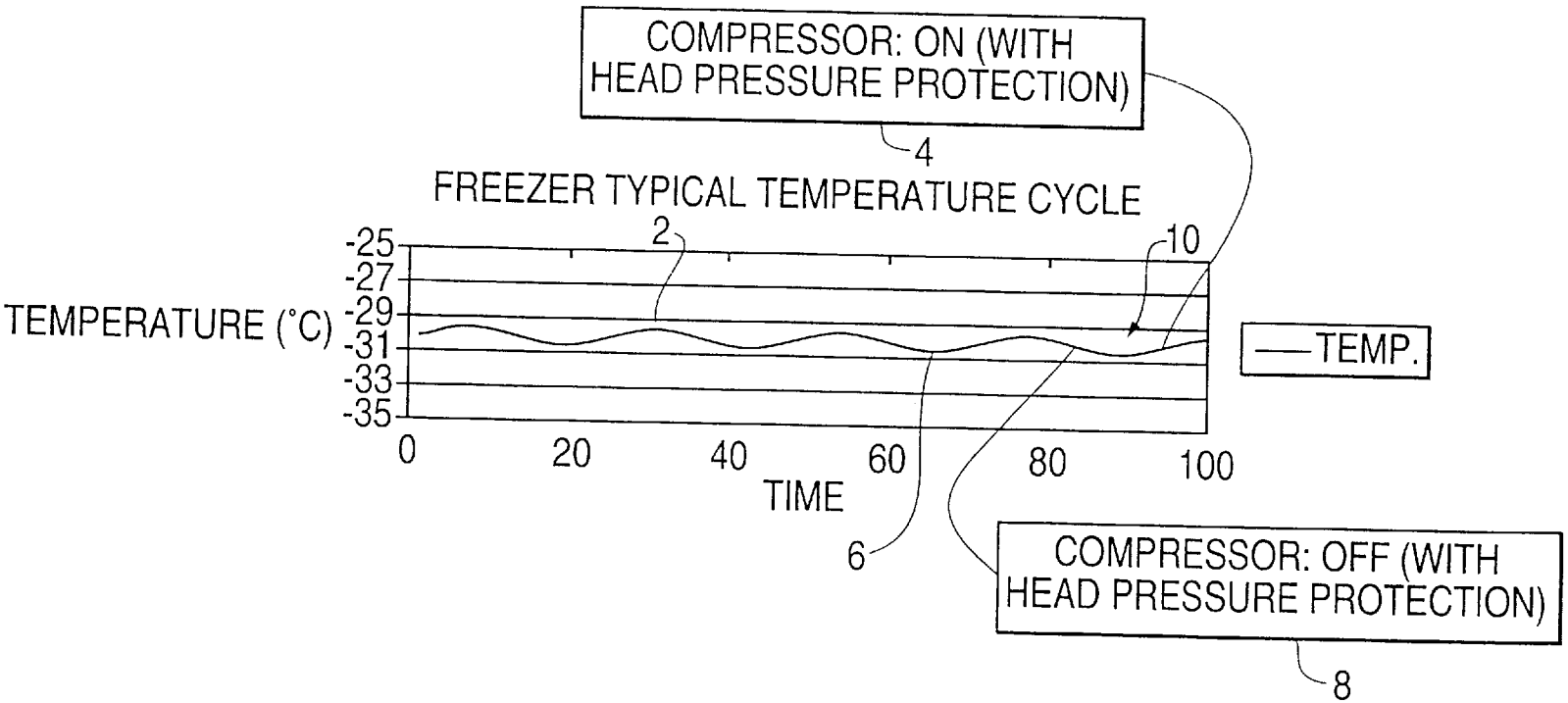
FIG. 1 is a graph depicting a normal temperature cycle for a −30° C. freezer with a temperature setpoint of −30° C.

Referring now to the figures, in FIG. 1 a preferred embodiment of the present invention is depicted in which an automatic freezer defrost cycle is shown that is independent of the normal cabinet temperature cycle 10. Thus, the defrost cycle may initiate at warmer temperatures within the normal temperature cycle 10 and therefore expose the interior of the freezer to warmer temperatures.

Improved automatic freezer defrost is accomplished by modifying the current algorithm in which defrosts occur at regularly scheduled intervals. For example, the −30° C. freezer initiates a defrost cycle every six hours and is delayed only by compressor short cycle delays associated with head pressure criteria. Thus, defrost cycles are dependent of the normal cabinet temperature cycle. This permits defrosts to initiate at cooler temperatures within the normal temperature cycle and thus exposes the interior of the freezer to warmer temperatures less frequently.

To overcome this problem and because the scheduled interval for defrosts does not have to be precise (+/− one hour), a defrost can be initiated six hours after the previous defrost but will be delayed until the normal temperature cycle 10 is at the next temperature minimum 6. In this way, all defrosting occurs when the cabinet is at the lowest temperature 6 of the normal temperature cycle 10 and the maximum temperature 2 the interior cabinet will attain will be minimized. Maximum temperature 2 in the normal temperature cycle 10 is the worst time for a defrost to occur because the cabinet temperature of the freezer will reach a higher temperature than necessary. It should be noted that a timeout condition may be needed for bottom-out conditions where a unit never achieves temperature setpoint in the cycle.

Thus, to optimize the defrost cycle, it is best to initiate a defrost at the low point 6 in the temperature cycle 10. This low point 6 of the normal temperature cycle 10 is the ideal point in the cycle for a defrost to occur. Initiating defrost at the low point 6 will minimize the maximum temperature experienced by the cabinet 29. As the system is controlled via an embedded microcontroller based system 30, and this same system controls the defrost and temperature cycle, it is possible to employ an algorithm 11 that looks for this low point 6 temperature condition to initiate a defrost. The algorithm 11 will work as indicated in the flowchart of FIG. 2.

Figure 2:
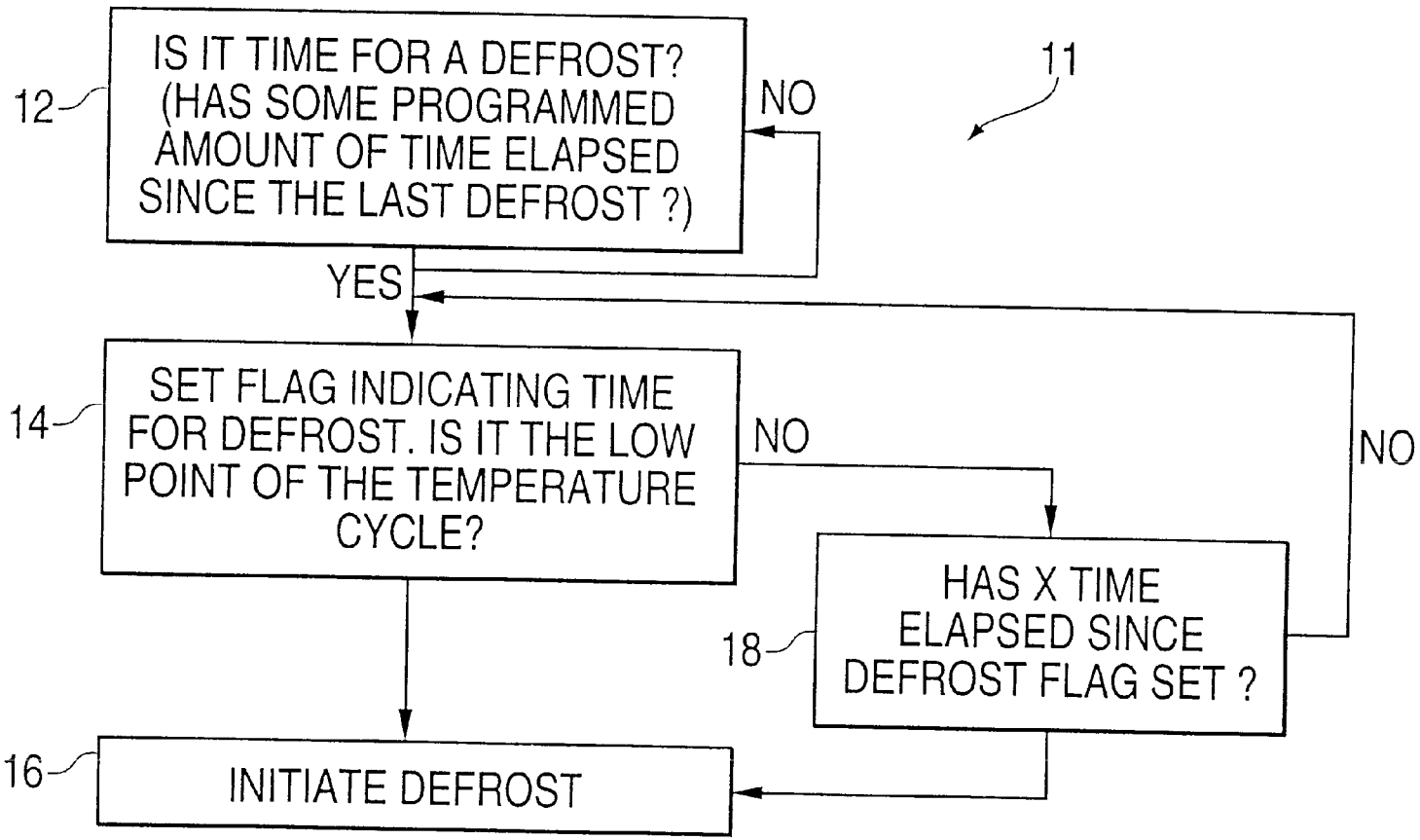
FIG. 2 is a flowchart illustrating the steps that may be followed in accordance with one embodiment of the present inventive method or process.

Referring now to FIG. 2, in the preferred embodiment the invention, the first step is determining when a defrost cycle should be initiated based on a predetermined elapsed time 12. The second step is setting a flag which indicates a time to initiate a defrost cycle 14 and begin monitoring for the next low point in the temperature cycle 18. The last step is to initiate the defrost cycle once the low point of the temperature cycle has been reached 16.

Referring back to FIG. 1, the determination of the low point 6 in the temperature cycle 10 can be determined in numerous ways. In a preferred embodiment if the compressor is off 8 and the cabinet temperature is less than setpoint, the temperature cycle is at or near minimum and defrost can initiate. However, if the compressor is on 4 wait until the compressor deactivates 8 as the temperature cycle crosses below setpoint and wait an additional delay that is statistically representative of the avg. time to the low temp. point of the cycle and initiate defrost. It should be noted that the timeout condition for the start-of-defrost prevents the scenario in which the unit never achieves temperature setpoint and the compressor is continuously running (typically termed a "bottom-out condition"), i.e., the unit is unable to achieve setpoint. It should be further noted that the timeout condition delay should be longer than the delay from compressor deactivation 8.

Figure 3:
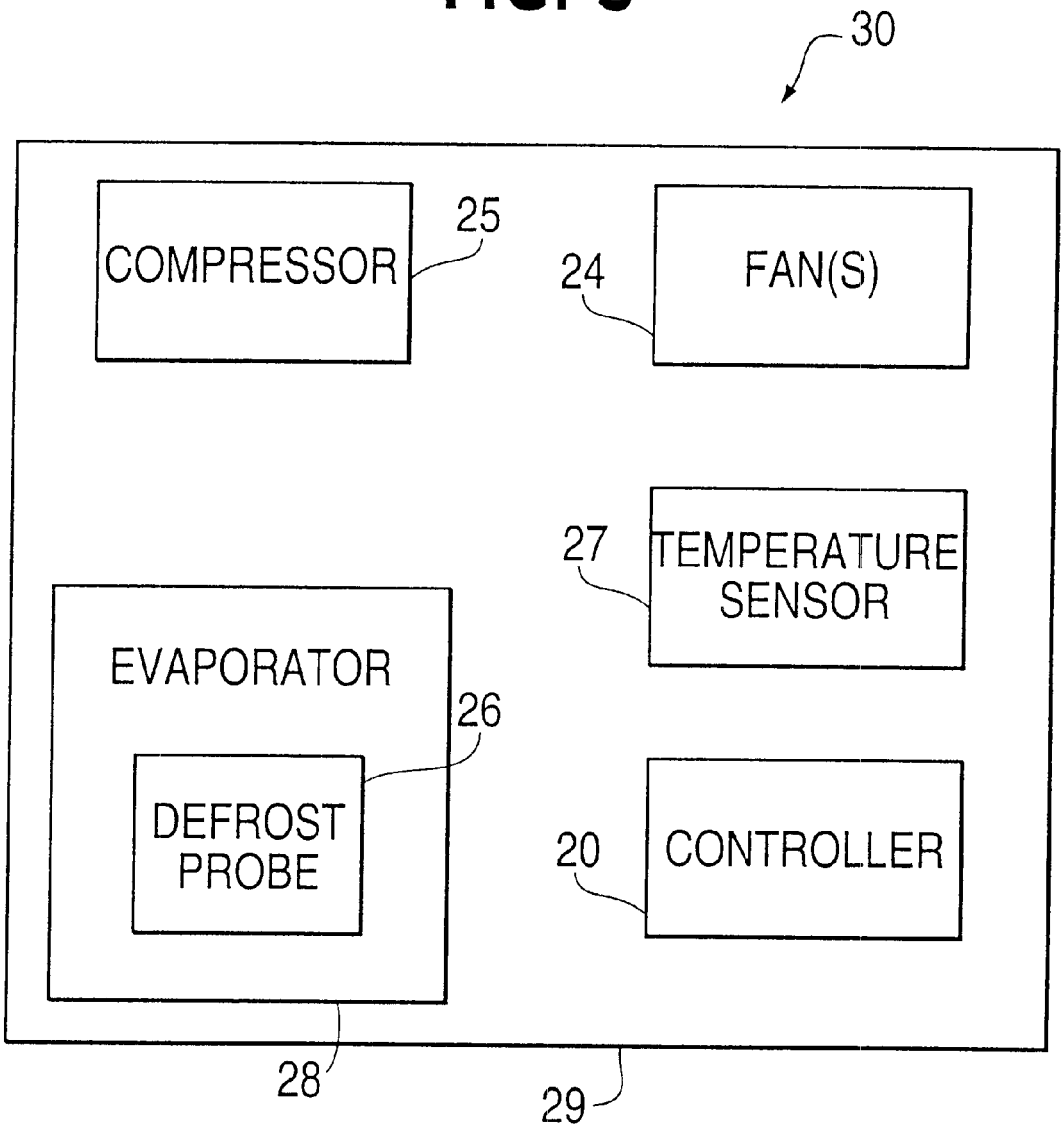
FIG. 3 is a block diagram of the freezer unit in accordance with one embodiment of the present invention.

Referring now to FIG. 3, in the preferred embodiment a freezer unit 30 having a cabinet 29 containing a compressor 25, an evaporator 28 with a defrost probe 26, circulation fan(s) 24, a temperature sensor 27 and a controller 20. The controller 20 will deactivate the circulation fan 24 at defrost initiation and will not reactivate the fan 24 until the defrost cycle is completed and the defrost probe 26 (located in the evaporator 28) has attained −15° C. The temperature sensor 27 is connected to the controller 20 in order to monitor the normal temperature cycle 10 prior to initiating a defrost.

Typically, a defrost cycle is initiated and either reaches a minimum temperature for "tempout conditions" (i.e., the evaporator attains minimum de-ice temperature) or the maximum defrost time expires and the defrost cycle is completed. This promotes periodic defrost efficiency by preventing any unnecessary temperature increase in the evaporator 28. If the defrost probe 26 is faulty, intermittent, or not calibrated properly, it is possible that the circulation fans 24 will not begin rotating. If such a failure occurs it is desirable that a failure mode will be established wherein the cabinet 29 will not rise above approximately −15° C. Situations like this have been experienced in the field. If the fans 24 were redundantly protected by a timeout condition, then the cabinet 29 will return to setpoint even though the defrosts will not be optimal. This mode of failure is far superior than failure modes currently employed and only requires a firmware adjustment to implement.

After the compressor 25 is activated 4 to cool at the end of a defrost cycle, the circulation fan(s) 24 will not begin to circulate until the defrost probe 26 has achieved a temperature less than −15° C. It is noted that the end of a defrost cycle itself does not constitute the compressor cooling. Typically the cabinet temperature requirements will not be met and cooling will begin immediately after the defrost and compressor head pressure requirements are satisfied.

If the fan(s) 24 fail to circulate, the failure mode is that the cabinet will stabilize at approximately −10 to −15° C. Considering, most setpoints are in the −25 to −30° C. range, this is a critical failure. As a protection against this mode of failure, the preferred embodiment will use a time that is statistically longer than the average time for fan(s) 24 to initiate after defrost, i.e., the time it takes the defrost probe temperature to be less than −15° C. and even if the defrost probe 26 fails to achieve −15° C. the fan(s) 24 will activate after the delay and the cabinet 29 will cool to setpoint or bottom-out. Although this situation does not allow for optimum defrost cycles, it is certainly an improvement and a better mode of failure and hence relates directly to reliability.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of automatic freezer defrost, comprising the steps of:

determining when a defrost cycle should be initiated based on a predetermined elapsed time, setting a flag which indicates a time to initiate the defrost cycle, monitoring for a low point of the temperature cycle or timeout due to a bottom-out condition, and initiating said defrost cycle.

2. The method of claim 1, wherein said flag is set at least six hours after a previous defrost cycle.

3. The method of claim 1, wherein the low point is the minimum temperature in the temperature cycle.

4. The method of claim 2, further comprising the step of delaying said defrost cycle initiation until the next low point occurs in the temperature cycle.

5. The method of claim 1, further comprising the steps of:

deactivating a circulation fan upon initiation of said defrost cycle and reactivating said circulation fan upon the completion of said defrost cycle.

6. The method of claim 5, wherein a defrost probe determines when said circulation fan deactivates and reactivates.

7. The method of claim 6, wherein said defrost probe must attain at least −15° C. to reactivate said circulation fan after said defrost cycle.

8. The method of claim 5, further comprising the step of reactivating said circulation fan after a predetermined time delay.

9. A freezer unit, comprising:

an automatic defrost controller, a temperature sensor connected to said controller, a defrost probe connected to said controller, and at least one circulation fan connected to said controller, wherein said controller initiates a defrost cycle at a low point of a temperature cycle as indicated and monitored by said temperature sensor.

10. The freezer unit of claim 9, wherein said defrost probe determines when said at least one circulation fan deactivates and reactivates.

11. The freezer unit of claim 10, wherein said defrost probe must attain at least −15° C. to reactivate said at least one circulation fan after said defrost cycle.

12. The freezer unit of claim 11, wherein said at least one circulation fan reactivates after a predetermined time delay independent of said defrost probe.

13. The freezer unit of claim 10, wherein the low point of the temperature cycle is the temperature cycle minimum point.

14. The freezer unit of claim 10, wherein said defrost probe is located in said evaporator.

15. A freezer unit including a cabinet, evaporator and a compressor, comprising:

means for determining when a defrost cycle should initiate based on a predetermined elapsed time and for checking if a low point in a temperature cycle has been reached, means for setting a flag which indicates a time to initiate a defrost cycle and for monitoring for a low point in the temperature cycle, and means for initiating said defrost cycle once said low point of the temperature cycle has been reached or timeout for bottom-out condition.

16. The freezer unit of claim 15, wherein said means for determining when said defrost cycle should initiate and for monitoring for a low point in the temperature cycle is a temperature sensor.

17. The freezer unit of claim 16, wherein said means for setting a flag and for initiating said defrost cycle is an embedded microcontroller.

18. The freezer unit of claim 17, wherein said defrost probe is located in said evaporator.

19. The freezer unit of claim 18, wherein said flag is set at least six hours after a previous defrost cycle.

20. The freezer unit of claim 19, wherein the low point of the temperature cycle is the temperature cycle minimum point.

* * * * *